US006691996B2

(12) United States Patent
Kaya et al.

(10) Patent No.: US 6,691,996 B2
(45) Date of Patent: Feb. 17, 2004

(54) LAP SEPARATOR FOR SHEET-RECEIVING POCKETS AND METHOD FOR SEPARATING LAPS IN SHEET-RECEIVING POCKETS

(75) Inventors: Mehmet Oktay Kaya, Lee, NH (US); Heiner Philipp Luxem, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/178,642

(22) Filed: Jun. 24, 2002

(65) Prior Publication Data

US 2003/0234482 A1 Dec. 25, 2003

(51) Int. Cl.[7] ..... B45H 5/30; B42B 2/00

(52) U.S. Cl. ..... 270/52.25; 270/52.23; 270/52.19; 270/52.14

(58) Field of Search ..... 270/52.14, 52.19, 270/52.23, 52.24, 52.25

(56) References Cited

U.S. PATENT DOCUMENTS

| | | | | |
|---|---|---|---|---|
| 3,891,202 A | | 6/1975 | Kircher | |
| 4,046,367 A | * | 9/1977 | Merker et al. | 270/52.24 |
| 4,133,521 A | | 1/1979 | Müller | |
| 4,373,710 A | | 2/1983 | Hansen et al. | |
| 4,723,770 A | | 2/1988 | Seidel et al. | |
| 4,988,086 A | | 1/1991 | Schlough | |
| 5,024,432 A | | 6/1991 | Thünker et al. | |
| 5,050,851 A | * | 9/1991 | Eugster | 270/52.22 |
| 5,065,994 A | * | 11/1991 | Hatt | 270/52.23 |
| 5,112,036 A | * | 5/1992 | Hatt | 270/52.23 |
| 5,171,005 A | * | 12/1992 | Manley et al. | 270/1.02 |
| 5,213,318 A | | 5/1993 | Newhall | |
| 5,251,888 A | | 10/1993 | Eugster | |
| 5,269,504 A | * | 12/1993 | Backman | 270/52.2 |
| 5,560,594 A | * | 10/1996 | Gosslinghoff | 270/52.24 |
| 5,911,416 A | | 6/1999 | Klopfenstein | |
| 6,234,466 B1 | * | 5/2001 | Infanger | 270/52.23 |
| 6,311,968 B1 | | 11/2001 | Linder et al. | |

* cited by examiner

*Primary Examiner*—Patrick Mackey
(74) *Attorney, Agent, or Firm*—Laurence A. Greenberg; Werner H. Stemer; Ralph E. Locher

(57) ABSTRACT

A lap separator system opens a sheet in a pocket traveling in a direction at a given speed, the pocket having forward and rearward walls pivotally connected to one another and, together, defining a sheet-receiving opening, and includes a moveable separator carrier, a separator connected to the carrier, the separator carrier conveying the separator in the transport direction along the pocket at a speed greater than the given speed, and the separator sequentially contacting the rearward wall, the sheet in the pocket, and then the forward wall and sequentially releasing the rearward wall, at least a portion of the sheet in the pocket, and then the forward wall. The system can be part of a sheet-collating machine having a conveyor, a sheet feeding device, and many pockets. A method for opening a sheet includes displacing the separator to sequentially contact and release the walls and sheet.

28 Claims, 6 Drawing Sheets

LAP SEPARATOR FOR SHEET-RECEIVING POCKETS AND METHOD FOR SEPARATING LAPS IN SHEET-RECEIVING POCKETS

BACKGROUND OF THE INVENTION

1. Field of the Invention

The invention lies in the field of printing presses. The present invention relates generally to a sheet-conveying apparatus, for example, for conveying newspapers, and, more particularly, to a sheet conveying apparatus having pockets moving on a track. In particular, the invention relates to a lap separator for separating forward and rearward laps of a folded first sheet material section in a pocket to allow nesting of a second section therein and a method for separating such laps.

2. Background Information

Sheet-conveying devices, in particular, devices for conveying newspapers, are required to be able to insert or nest or collate various sets of sheets inside one another. Specifically, to create a finished newspaper, a first folded section of the paper, taking the form of a folded sheet section, is opened and at least one second section of the newspaper is inserted between the two sides of the folded sheet section. It is possible that the second section is, itself, a section having third, fourth, or more other sections nested therein in the same manner as the first section. To process such sheets, in particular, newspapers, prior art conveying devices have an angle-shaped pocket that first picks up a first section, opens the first section, and then conveys the opened first section to a delivery station. Prior art systems including pockets include, for example, U.S. Pat. No. 4,133,521 to M üller and U.S. Pat. No. 5,213,318 to Newhall. A delivery unit drops the second section into the opened first section to create a nested paper with two sections. This process can be repeated for many different sections to create an entire newspaper.

There is a difficulty associated with the pocket properly opening the first section to the appropriate opening position. To facilitate proper opening, each section is formed with a lap. In other words, the two ends of the folded sheet section are not even. Typically, in a sheet-processing direction, the forward-most end of the folded sheet section is longer than the rear-most end of the folded sheet section. Thus, if the fold of the sheet section is at the bottom of the pocket, when viewing the ends of the folded sheet section in the pocket from above, the forward lap is higher than the rear lap.

In such a position, the folded sheet section can be opened if the forward, higher lap is secured by a device (applying a physical contact and/or air suction) and the pocket or folded sheet section is moved or tilted to allow gravity (possibly assisted with suction) to let the rear lap fall away from the forward lap. After the rear lap has fallen or is moved away from the forward lap, there exists an opening into which a second section can be inserted. Accordingly, a second section can be inserted into or nested within the first section. This combined section can then be inserted into a further section, and so on, to create a multiply nested set of sheets, typically, forming a common newspaper.

The securing device typically takes the form of a finger-shaped gripper. In the opening process, such a gripper is rotated or lowered onto the forward lap to secure the forward lap, and the forward sheet section, to a front wall of the pocket. Some examples of prior art gripper systems in such pockets include U.S. Pat. No. 4,723,770 to Seidel et al., U.S. Pat. No. 4,988,086 to Schlough, and U.S. Pat. No. 5,024,432 to Thünker et al.

U.S. Pat. No. 5,911,416 to Klopfenstein describes a sheet material conveying apparatus with a plurality of pockets moveable around a track to accept sheet material from sheet material feeders. These pockets permit, for example, a first outer section of a newspaper to first be fed into the pockets by a first sheet material feeder, and then an inner newspaper section to be inserted between the folds of the first outer newspaper section. The Klopfenstein apparatus uses a lift cam 20 to move a semicircular actuator gear 150 to rotate a drive shaft 110 so as to set a height for pocket feet 90 disposed on racks 80. A pawl and ratchet mechanism prevents the pocket from opening. The sheet material can then be accepted and inserted into the pockets. To deliver the sheet material, a trip cam 22 can release the pawl and ratchet mechanism. Tracks 80 move to a lower position through a biasing spring, so that feet 90 release through operation of a driver cam 130. The sheet material in the pocket can, thus, move out of the pocket from the bottom to be further conveyed or to be stacked. The entirety of Klopfenstein is hereby incorporated by reference.

U.S. Pat. No. 5,251,888 to Eugster purports to describe pockets moveable along an endless path. Each pocket is provided with two vertically adjustable stops 14 mounted displaceably in a pocket carrier 8. A guide member 28 purportedly can be set to vertically adjust the stops 14 as the pockets are moved along the endless path.

Because sheet delivery devices travel at relatively high speeds, the window of time for gripping the forward lap is small. Accordingly, there is a need to expand the window of time for gripping the forward lap. Significantly, lap sizes are neither consistent nor equal. Therefore, expansion of the time window must also be able to compensate for variations in lap sizes.

SUMMARY OF THE INVENTION

It is accordingly an object of the invention to provide a lap separator for separating forward and rearward laps of a folded first sheet material section in a pocket to allow nesting of a second section therein and a method for separating such laps that overcome the hereinafore-mentioned disadvantages of the heretofore-known devices and methods of this general type and that expands the time window for separating the forward lap from the rearward lap while also accommodating variations in size of forward and rearward laps.

Commonly assigned U.S. patent application Ser. No. 09/662,277, entitled "SHEET MATERIAL CONVEYING APPARATUS WITH INDIVIDUALLY-ADJUSTABLE POCKETS" filed on Sep. 14, 2000, describes a plurality of manually-adjustable pockets, each having a setting device for adjusting a height of the pocket.

Commonly assigned U.S. patent application Ser. No. 09/702,012, entitled "SHEET MATERIAL CONVEYING APPARATUS WITH HEIGHT-ADJUSTABLE POCKETS" filed on Oct. 30, 2000, describes a plurality of manually adjustable pockets, each having a setting device for adjusting a height of the pocket so as to define a set height.

Commonly assigned U.S. patent application Ser. No. 10/178,645, entitled "ADJUSTABLE GRIPPING DEVICE FOR ADJUSTABLE SHEET RECEIVING POCKETS AND METHOD FOR ADJUSTING SHEET RECEIVING POCKETS" and filed concurrently herewith, describes a different gripper adjusting system 70 having an adjustable gripper 71 with two main parts, a gripper body 72 and an adjustment device 73 including a pivot 75, a cam follower 77, and an adjustment body 79 in the form of a two-arm rocker. Depending on a placement setting of a vertically adjustable cam 26, the adjustment body 79 pivots and moves a nose 74 of gripper body 72 along the surface of upper front wall 52 away from or towards the uppermost edge of the rearward lap 63.

Commonly assigned U.S. patent application Ser. No. 10/178,645 entitled "ADJUSTABLE GRIPPING DEVICE FOR ADJUSTABLE SHEET-RECEIVING POCKETS AND METHOD FOR ADJUSTING SHEET-RECEIVING POCKETS" and filed concurrently herewith, describes a different gripper adjusting system 70 where each gripper 71 is individually adjustable through a gripper plunger 73 having a plunger body 75 with a nose, a rod 76, and a cam follower 77 attached to the end of rod 76. The nose directly contacts and holds forward lap 61 of a section 6, or holds the entire section 6, 61, 63. Depending on a setting of a vertically adjustable cam 26 the nose moves away from or towards an upper edge of the rearward lap 63.

Each of these commonly assigned applications are hereby incorporated by reference herein.

With the foregoing and other objects in view, there is provided, in accordance with the invention, a lap separator system for opening a sheet in a pocket traveling in a transport direction at a given speed, the pocket having forward and rearward walls pivotally connected to one another, the forward and rearward walls together defining an opening for receiving the sheet, the lap separator system including a moveable separator carrier, at least one separator connected to the separator carrier, the separator carrier adapted to convey the at least one separator in the transport direction along the pocket at a speed greater than the given speed, and the at least one separator adapted to sequentially contact the rearward wall, the sheet in the pocket, and then the forward wall and to sequentially release the rearward wall, at least a portion of the sheet in the pocket, and then the forward wall.

In accordance with another feature of the invention, the separator is adapted to sequentially release the rearward wall, at least a portion of the sheet in the pocket, at least another portion of the sheet in the pocket, and then the forward wall.

In accordance with a further feature of the invention, the track has elevational change sections for displacing the separator with respect to the pocket. Preferably, the sections include inclines for displacing the separator away from the pocket and/or declines for displacing the separator towards the pocket.

In accordance with an added feature of the invention, the separator carrier is a track, preferably, an endless track.

In accordance with an additional feature of the invention, the separator is a plurality of separators. Preferably, the separator is of a flexible material. The separator can be a brush, a finger-shaped extension extending towards the pocket, a row of finger-shaped extensions each extending towards the pocket, a cylindrical rod, and/or a rectangular column.

With the objects of the invention in view, there is also provided a sheet-opening system, including at least one moveable pocket having forward and rearward walls pivotally connected to one another, the forward and rearward walls together defining an opening for receiving at least one sheet, the at least one pocket adapted to travel in a transport direction at a given speed and a lap separator system for opening the at least one sheet in the pocket, the separator system having a moveable separator carrier, at least one separator connected to the separator carrier, the separator carrier adapted to convey the at least one separator in the transport direction along the at least one pocket at a speed greater than the given speed, and the at least one separator adapted to sequentially contact the rearward wall, the at least one sheet in the pocket, and then the forward wall and to sequentially release the rearward wall, at least a portion of the at least one sheet in the pocket, and then the forward wall.

With the objects of the invention in view, there is also provided a sheet-collating machine, including a conveyor adapted to travel in a transport direction at a given speed, at least one sheet feeding device disposed at the conveyor for feeding at least one sheet towards the conveyor, pockets each having forward and rearward walls pivotally connected to one another, the forward and rearward walls together defining an opening for receiving the at least one sheet, each of the pockets connected to the conveyor, adapted to receive the at least one sheet from the at least one sheet feeding device, and adapted to transport the at least one sheet along at least a portion of the conveyor in the transport direction, and a lap separator system for opening the at least one sheet in at least one of the pockets, the separator system having a moveable separator carrier, at least one separator connected to the separator carrier, the separator carrier adapted to convey the at least one separator in the transport direction along the at least one pocket at a speed greater than the given speed, and the at least one separator adapted to sequentially contact the rearward wall, the at least one sheet in the pocket, and then the forward wall and to sequentially release the rearward wall, at least a portion of the at least one sheet in the pocket, and then the forward wall.

In accordance with yet another feature of the invention, the separator carrier and/or the separator are adjustable in a vertical direction with respect to the pockets.

With the objects of the invention in view, there is also provided a method for opening a sheet within at least one sheet-receiving pocket of a sheet-collating device, including the steps of conveying the at least one sheet-receiving pocket along a transport path in a transport direction at a given speed, the pocket having forward and rearward walls pivotally connected to one another, the forward and rearward walls together defining an opening for receiving the sheet, placing the sheet in the at least one sheet-receiving pocket, conveying at least one separator on a separator carrier along a second transport path in the transport direction at a speed greater than the given speed, and sequentially contacting the rearward wall, the sheet in the pocket, and then the forward wall with the at least one separator and then sequentially releasing the at least one separator from the rearward wall, at least a portion of the sheet in the pocket, and then the forward wall.

In accordance with yet a further mode of the invention, the pocket is a plurality of pockets and the separator is a plurality of separators.

In accordance with yet an added mode of the invention, the second transport path is adjacent and/or follows the transport path.

With the objects of the invention in view, there is also provided a method for opening a sheet within a sheet-receiving pocket, including the steps of providing sheet-receiving pockets to be conveyed in a transport path, each pocket having forward and rearward walls pivotally connected to one another, the forward and rearward walls together defining an opening for receiving the sheet and displacing at least one separator to sequentially contact the rearward wall, the sheet in the pocket, and then the forward wall and then to sequentially release the at least one separator from the rearward wall, at least a portion of the sheet in the pocket, and then the forward wall.

"Rod" as defined herein can be any elongated structure.

Other features that are considered as characteristic for the invention are set forth in the appended claims.

Although the invention is illustrated and described herein as embodied in a lap separator for separating forward and rearward laps of a folded first sheet material section in a pocket to allow nesting of a second section therein and a method for separating such laps, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
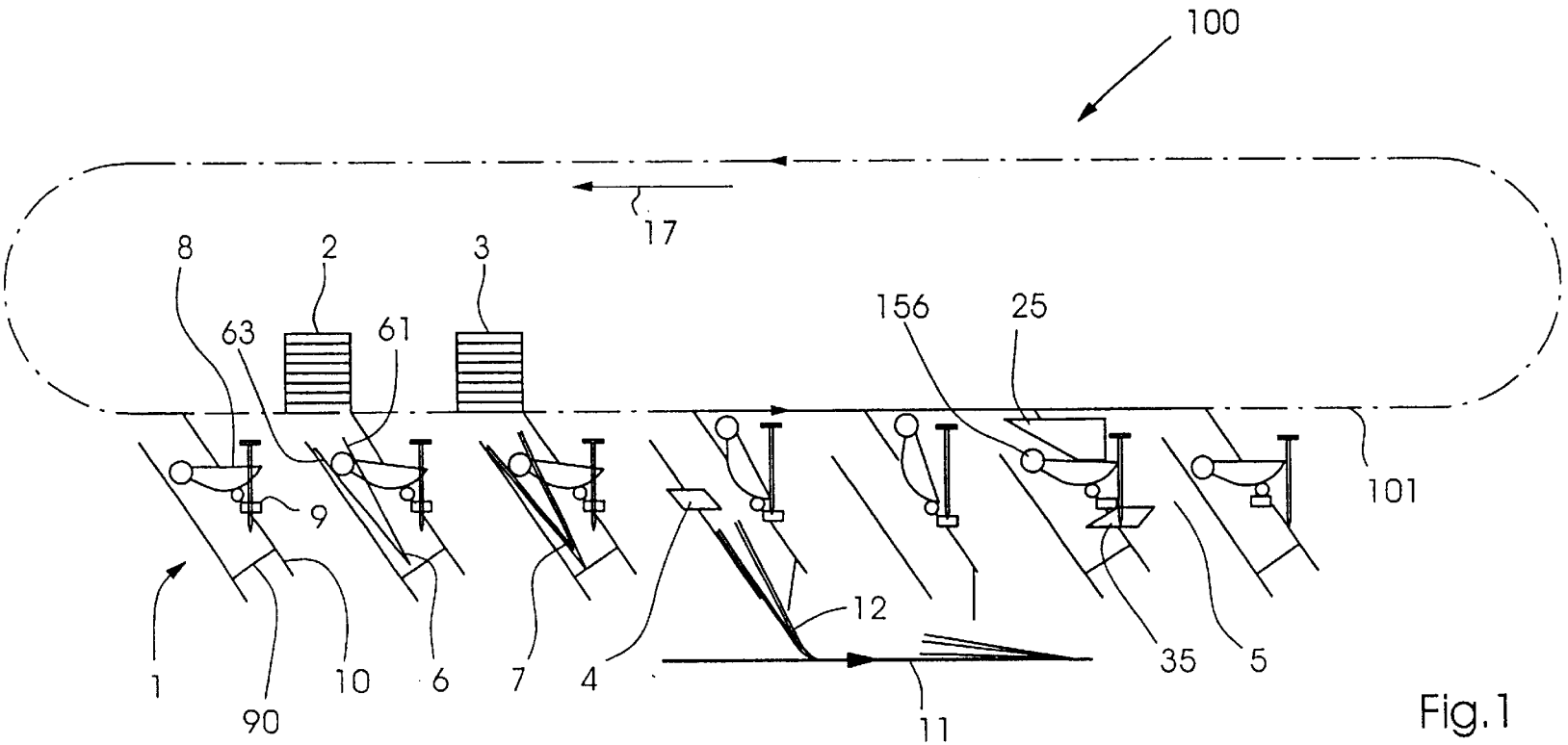
FIG. 1 is a diagrammatic perspective view of a sheet material conveying apparatus according to the invention.

Referring now to the figures of the drawings in detail and first, particularly to FIG. 1 thereof, there is shown a diagrammatic representation of a sheet material conveying apparatus 100 having an endless track 101 for transporting a plurality of pockets 10 in transport direction 17. Each pocket 10 includes moveable fingers 90 for defining a pocket height, an individual height setting mechanism 8, and a releasable lock mechanism 9 for height setting mechanism 8. Fingers 90 are movable about a pivot 96.

At a setting area 1, each pocket 10 can be set manually by setting mechanism 8 to move fingers 90 to at least one of two desired heights, for example, a setting for receiving 10__-inch folded products. Pockets 10 are stationary during setting, and the setting can occur outside setting area 1 as well, for example, by an operator moving about track 101. Alternatively, pockets 10 can be moved to setting area 1, the apparatus can be stopped, and each pocket 10 can be set. An automated robot for interacting with setting mechanism 8 also could be located at setting area 1 to move each pocket 10 to the proper height, as each pocket 10 is moved to and stopped at setting area 1.

After a pocket 10 is set to a desired height, setting mechanism 8 is then locked in place by lock mechanism 9 so that the pocket height is set. After all pockets 10 are set, they are moved to pass beneath a first sheet material feed station 2 where, for example, a folded cover section 6 of a newspaper or other printed product, also referred to as a jacket, is delivered into pocket 10. At a second and optional sheet material feed station 3, a second section 7 may be inserted between forward and rear portions of cover section 6 to form a final printed product 12. This process can be repeated for any number of feed stations 2, 3 to create a final product 12 having many nested sections 6, 7. Accordingly, a time period between receipt in pocket 10 of section 6 from station 2 and placement of pocket 10 beneath station 3 defines the window of time for separating section 6 into a pocket to receive section 7 therein.

After receiving sections 6, 7, pockets 10 can then pass a release station 4, which releases lock mechanism 9. Setting mechanism 8, which is, preferably, spring-loaded, then releases fingers 90 so that the bottom of pocket 10 opens, and finished products 12 are delivered, for example, to a conveyor belt 11.

As pockets 10 continue past release station 4, pockets 10 pass through a reset station 5, which can include a movable incline reset ramp 25 for interacting with a reset cam follower 156 (see FIG. 3) of setting mechanism 8 and a lock engagement device 35 for locking lock mechanism 9. Pockets 10, which are preferably all set to a common height, are then reset to the common height by reset ramp 25 and locked into place by lock engagement device 35 engaging lock mechanism 9.

Figure 2A:
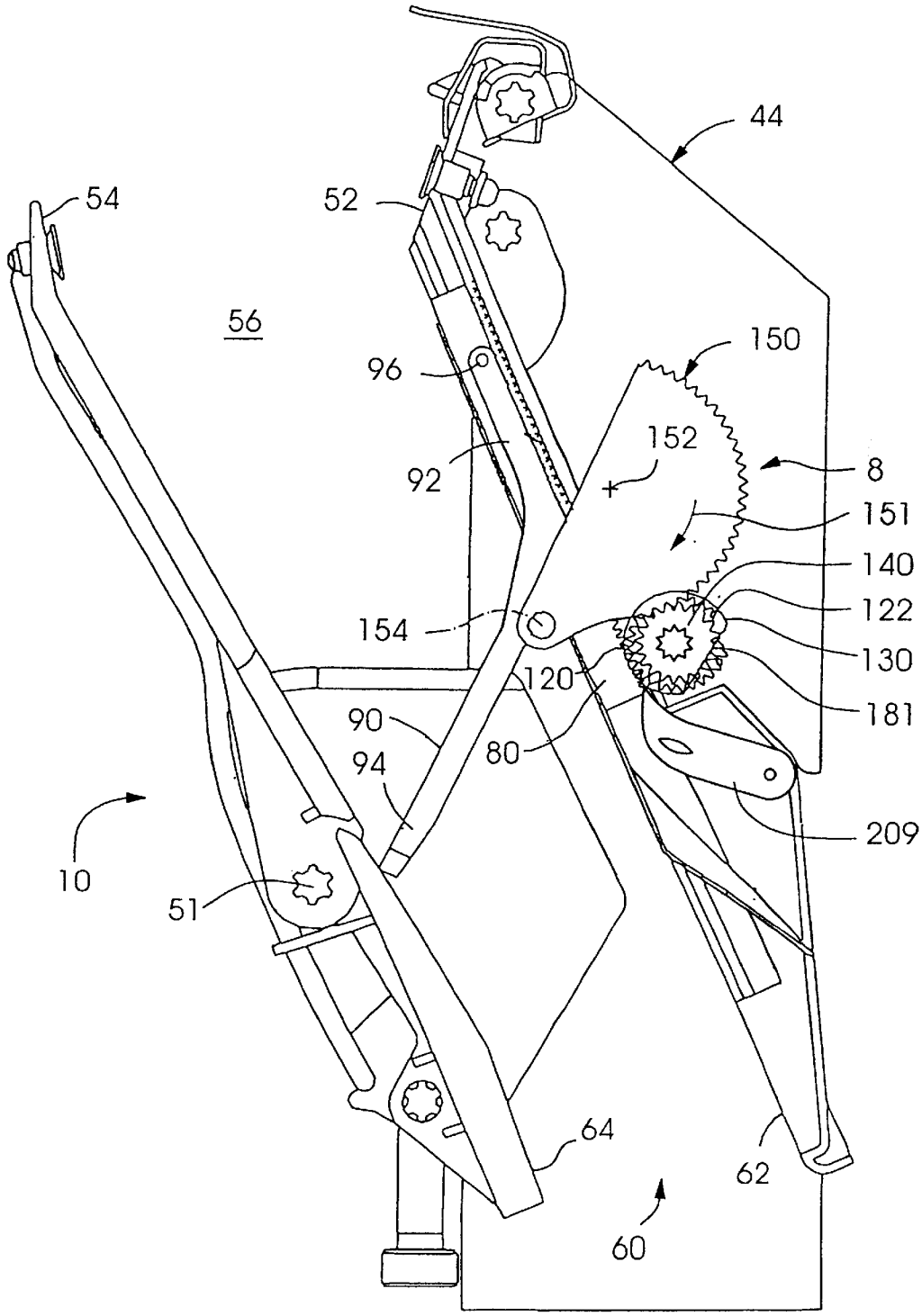
FIG. 2A is a side view of a pocket according to the invention with certain elements omitted for clarity.
Figure 3:
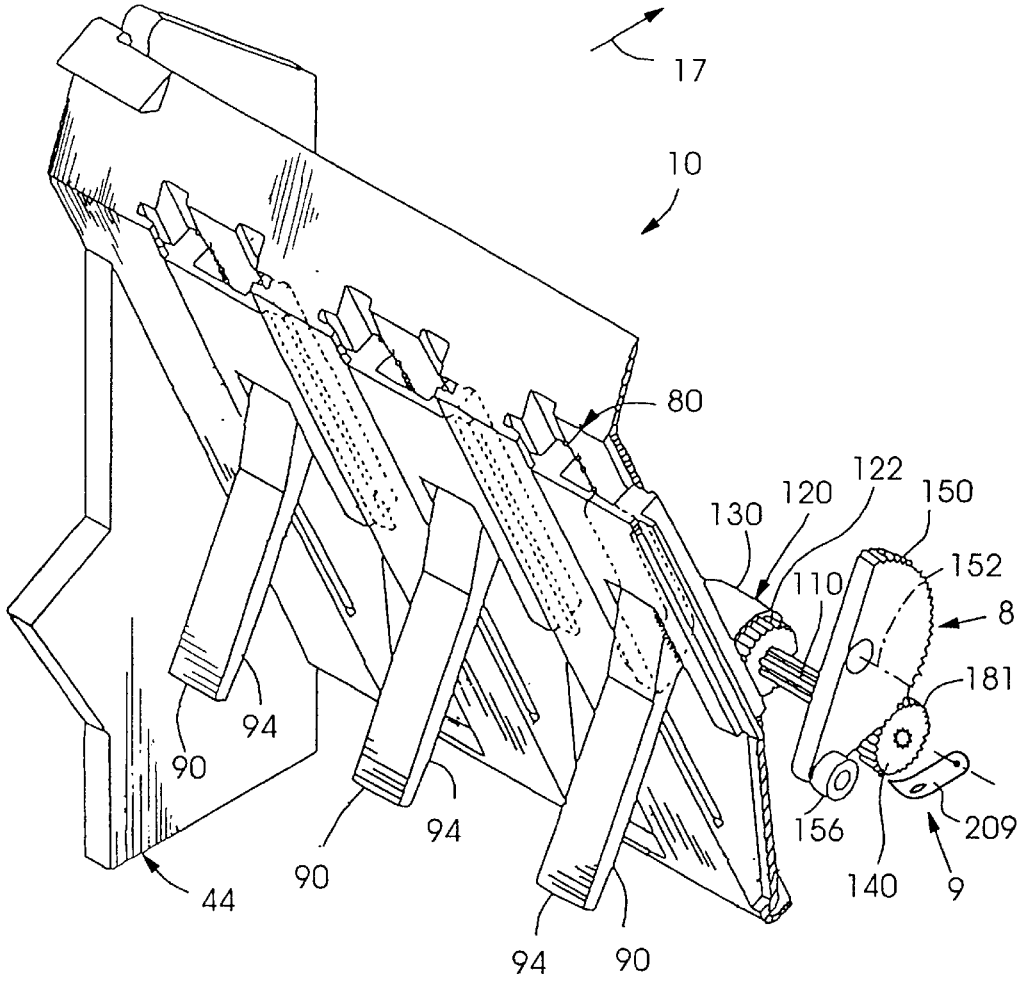
FIG. 3 is a fragmentary perspective view of a pocket according to the invention with certain elements omitted for clarity.
Figure 4:
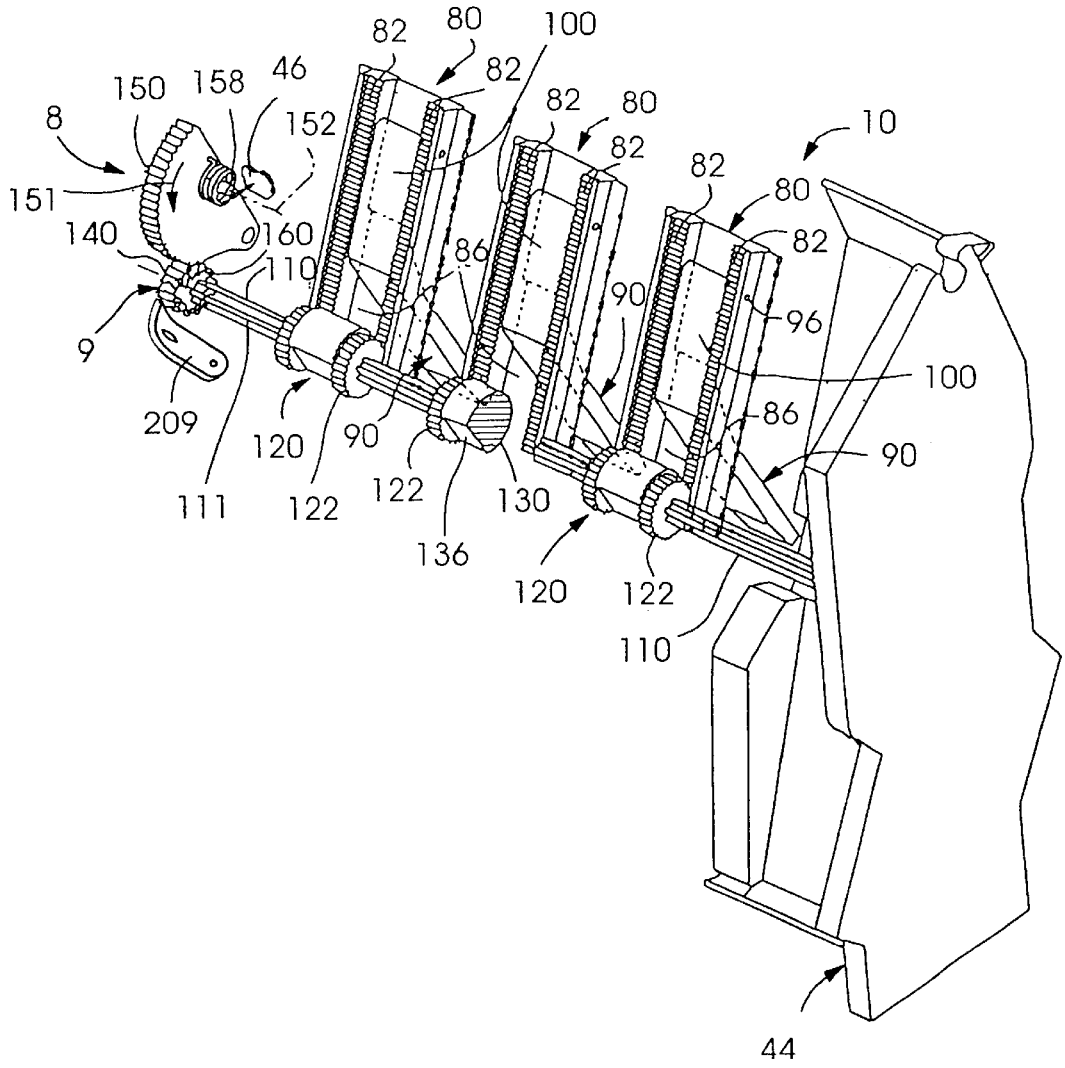
FIG. 4 is a different, fragmentary perspective view of the pocket according to FIG. 3.

FIGS. 2A, 3, and 4 show more details of pocket 10.

Pocket 10 has an upper rear wall 54 and an upper front wall 52, in between which is an opening 56 for accepting sheet material, for example, cover section 6. Pocket 10 also has a side wall 44. Pocket 10 also may have a lower rear wall 64 and a lower front wall 62.

Figure 2B:
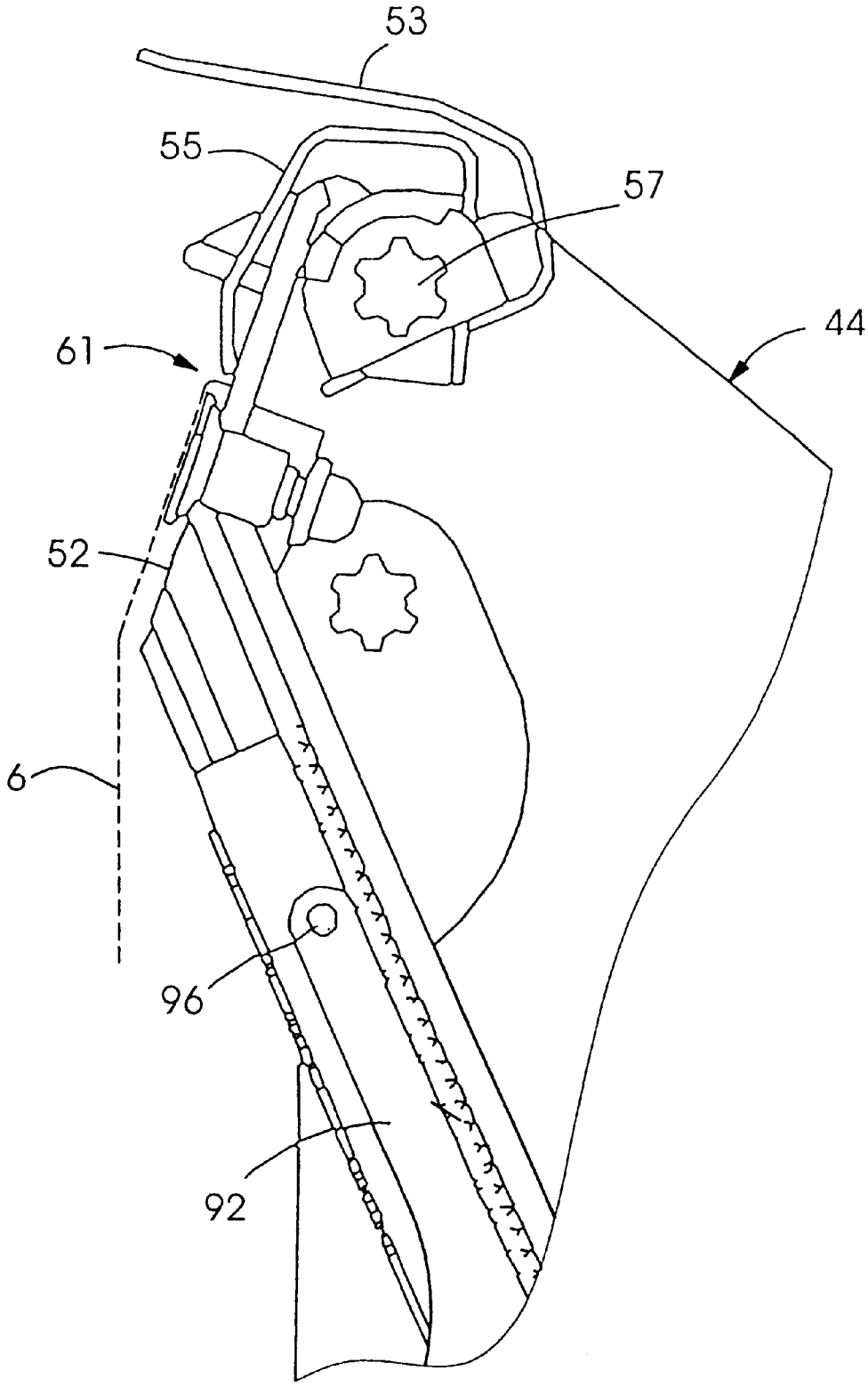
FIG. 2B is an enlarged side view of the pocket of FIG. 2A illustrating a detail of a gripper according to the invention.

FIG. 2B is an enlarged view of the upper portion of pocket 10 illustrated in FIG. 2A. FIG. 2B shows the area where a forward lap 61 of cover section 6 is held. To hold cover section 6 in place, a set of grippers 53, 55 are located at the top of upper front wall 52. Grippers 53, 55 are shown coaxially disposed on a single shaft 57, albeit in different rotational positions. However, alternatively, different sets of grippers can be disposed on different shafts, each being independently controlled. For example, grippers of one set can be longer than grippers of another set.

A non-illustrated control device pivots shaft 57 holding grippers 53, 55 between an engaged position and a disengaged position. In FIG. 2B, one gripper 53 is shown in the disengaged position and another gripper 55 is shown in the engaged position. In the engaged position, gripper 55 holds forward lap 61 of cover section 6 so that it is fixed with respect to upper front wall 52; cover section 6 being so held is shown diagrammatically in FIG. 2B with a dashed line.

Prior to the invention, section 6 separated according to a process described in the following text.

Figures 5A, 5B, 5C, 5D, 5E:
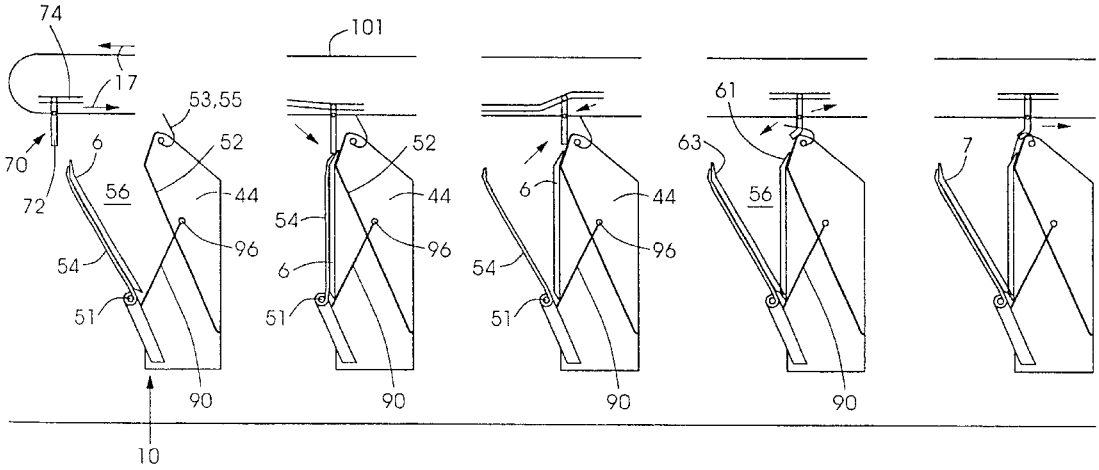
FIGS. 5A through 5E are diagrammatic cross-sectional views illustrating sequential phases of a lap separation system according to the invention.

When cover section 6 is first deposited in opening 56, the bottom (lowermost) edge of cover section 6 rests at the junction between fingers 90 and upper rear wall 54 as shown in FIG. 5A. In the open position of pocket 10, shown in FIGS. 2A and 5A, gravity causes cover section 6 to rest entirely against upper rear wall 54. See FIG. 5A. To begin a process for gripping cover section 6 with grippers 53, 55, upper rear wall 54 is pivoted about axis 51 to contact upper front wall 52, as shown in FIG. 5B. Alternatively and/or additionally, the entire rear wall 54, 64 can be displaced towards front wall 52, 62. When cover section 6 rests against upper front wall 52, grippers 53, 55 are rotated into the engaged position and hold at least a portion of cover section 6 in place against upper front wall 52. See FIGS. 2B, 5C, and 5D. If grippers 53, 55 are adjusted so that they extend no further than a top edge of rearward lap 63 of cover section 6, then grippers 53, 55 only grip forward lap 61 of over section 6. After which, forward lap 61 is held against upper front wall 52 and gravity and/or another device, such as a suction device 59, carries rearward lap 63 of cover section 6 along with the rearward-moving upper rear wall 54. Thus, an opening 56 is created between forward lap 61 and rearward lap 63 for receiving another section 7 therein, for example, from second sheet material feed station 3.

Timing is important for such a process. Grippers 53, 55 are delayed from engaging forward lap 61 until after upper rear wall 54 positively placed forward lap 61 on upper front wall 52. Time is also wasted by waiting until upper rear wall 54 and, with it, rearward lap 63, fell rearward sufficiently far enough to create an opening 56 permitting faultless placement of section 7 therein.

The invention extends the window of time for this process by providing a lap separating system 70. Lap separating system 70 includes at least one lap separator 72 moveably disposed on a lap separator carrier system 74 and operates as set forth in the following text.

Carrier system 74 is disposed near or at endless track 101, which forms a portion of a pocket conveyor system. Carrier system 74 moves in transport direction 17 the same as track 101. Preferably, carrier system 74 is an endless belt that follows pockets 10, but moves at a different speed. Also, carrier system 74 can be adjustable in a vertical direction with respect to pocket 10. Thus, a lap separator 72 can be adjusted to move closer to or further away from pocket 10. Such adjustment can be a movement of the entire system 70, or a movement of an individual lap separator 72. System 70 can be preset to a particular format or system 70 can include an automatic control system with adjustment motors and sensors for determining a position of a forward lap 61 or another portion.

As shown in FIG. 5A, a section 6 is first deposited in pocket 10 at station 2 (which is only illustrated in FIG. 1). Sometime thereafter, preferably, immediately thereafter, upper rear wall 54 and section 6 must be pivoted towards upper front wall 52 to begin the process for opening section 6 to receive another section 7. Accordingly, as shown in FIGS. 5A to 5B, a lap separator 72 is moved in transport direction 17 along with pocket 10, but faster than pocket 10. As such, lap separator 72 catches up with pocket 10 and overtakes it. Preferably, lap separator 72 overtakes pocket 10 immediately after section 6 securely lies in pocket 10.

Lap separator 72 has a length sufficient to contact a rearward side of upper rear wall 54 and impart a sufficient force to upper rear wall 54 to pivot upper rear wall 54 up to and against upper front wall 52, thereby clamping section 6 between upper rear wall 54 and upper front wall 52. Alternatively, if it is necessary to place an end of lap separator 72 lower with respect to pocket 10, carrier system 74 can be configured, as shown in FIG. 5B, to lower lap separator 72 towards pocket 10. Alternatively, or additionally, carrier system 74 can be configured, as shown in FIG. 5C, to raise lap separator 72 from pocket 10. A lowering or raising portion of carrier system 74 will be dependent upon a function that lap separator 72 needs to perform with respect to pocket 10. If lap separator 72 is not needed, it can be raised sufficiently far from pocket 10 such that lap separator 72 cannot contact any portion of pocket 10.

FIG. 5B illustrates a point in time where lap separator 72 has fully pressed upper rear wall 54 against upper front wall 52. In such a position, forward lap 61 clearly projects above rearward lap 63. Preferably, lap separator 72 is of a material that allows lap separator 72 to flex or bend. Thus, as lap separator is pressed against pocket 10, it flexes as shown in FIG. 5D.

Even though lap separator 72 is traveling with pocket 10, it is traveling faster. Accordingly, as lap separator 72 moves past or along pocket 10, at a point in time shown in FIG. 5C, the end of lap separator 72 has completely moved past upper rear wall 54. Because lap separator 72 is no longer pressing against upper rear wall 54, gravity, or some other device, such as a non-illustrated biasing spring, moves upper rear wall 54 back to its starting position shown in FIG. 5A. If rearward lap 63 is the same height or is shorter than upper rear wall 54, then rearward lap 63 will be carried back with upper rear wall 5, especially if upper rear wall 54 is provided with a suction device 59. If, however, rearward lap 63 is taller than upper rear wall 54, as shown in FIG. 5C, upper rear wall 54 will begin moving rearward in pocket 10 before rearward lap 63 moves at all because lap separator 72 will be pressing rearward lap 63 against upper front wall 52. Lap separator 72 continues moving past pocket 10 and, therefore, at a later point in time, lap separator 72 is no longer exerting pressure against rearward lap 63 and only exerts pressure against forward lap 61. When such pressure is released from rearward lap 63, it can then move rearward to create opening 56 for receiving section 7 as shown in FIG. 5D.

Throughout the time that lap separator 72 is pressing against upper front wall 52 (FIGS. 5B, 5C, 5D, 5E), pressure is exerted against forward lap 61. Especially after upper rear wall 54 and rearward lap 63 have fallen away from forward lap 61, lap separator 72 is exerting pressure against forward lap 61 as shown in FIG. 5E. Thus, grippers 53, 55 can move to secure forward lap 61 anytime after upper rear wall 54 and rearward lap 63 have fallen away from forward lap 61.

At the latest, grippers 53, 55 must grip forward lap 61 immediately before section 7 is deposited inside section 6.

Lap separator 72 contacts upper rear wall 54 immediately after pocket 10 receives section 6 and immediately begins moving in transport direction 17. The movement speed of lap separator 72 defines how fast upper rear wall 54 and rearward lap 63 fall away from forward lap 61. Because lap separator movement speed is relatively fast as compared to movement of pocket 10 along endless track 101, using the invention, upper rear wall 54 and rearward lap 63 fall away from forward lap 61 well before pocket 10 is placed under station 3 to receive section 7. Therefore, use of the invention speeds up separation of forward and rearward laps 61, 63, and, consequently, expands the time window available for gripping forward lap 61 with grippers 53, 55. Increasing the time window for gripping means that longer length grippers 53, 55 can be used.

Lap separator 72 can take any shape. It can be a single, solid, rectangular column extending into the plane of FIGS. 5A to 5E across the entire width of pocket 10 and having a cross-section as illustrated in FIGS. 5A to 5E. As such, the extent of the column into the plane is substantially greater than the vertical cross-section illustrated. Such a shape is possible because upper edges of upper rear wall 54, rearward lap 63, forward lap 61, and upper front wall 52 are all parallel with respect to one another in a direction extending into the plane of FIGS. 5A to 5E. Thus, a bottom edge of such a rectangular column will release each portion of a respective upper edge substantially simultaneously.

Alternatively, lap separator 72 can be a row of a plurality of finger-shaped devices extending from carrier system 74 towards a bottom of pocket 10 (i.e., in a direction of pivot 96). In contrast to the single rectangular column above, the extent of such finger-shaped devices into the plane of FIGS. 5A to 5E is substantially smaller than the illustrated vertical cross-section. These finger-shaped devices can take any shape, including a cylindrical rod or a rectangular column.

In a third embodiment, lap separator 72 can be a single finger-shaped device extending from carrier system 74 towards a bottom of pocket 10, the device having the same characteristics of the finger-shaped devices mentioned in the preceding paragraph.

In any of the three example embodiments, lap separator 72 can have a solid form. For example, the first embodiment would appear similar to a window squeegee. Alternatively, lap separator 72 can be a brush.

Preferably finger carrier system 74 is an endless belt having a plurality of removable, and, therefore, adjustable, individual lap separators 72 disposed along the extent of the endless belt. Positioning of lap separators 72 on the belt will, therefore, determine timing of lap separator's 72 action against a pocket 10.

As set forth above, up until the invention, there was a difficulty associated with separating forward lap 61 of a first section 6 from rearward lap 63 to create a pocket therebetween into which second section 7 can be inserted or nested. The invention adds a new lap separating system to expand the window of time that grippers 53, 55 have to grip forward lap 61. Simultaneously, the invention compensates for variations in size of the forward and rearward laps.

We claim:

1. A lap separator system for opening a sheet in a pocket traveling in a transport direction at a given speed, the pocket having forward and rearward walls pivotally connected to one another, the forward and rearward walls together defining an opening for receiving the sheet, the lap separator system comprising:

a moveable separator carrier;

at least one separator connected to said separator carrier;

said separator carrier adapted to convey said at least one separator in the transport direction along the pocket at a speed greater than the given speed; and said at least one separator adapted to sequentially contact the rearward wall, the sheet in the pocket, and then the forward wall and to sequentially release the rearward wall, at least a portion of the sheet in the pocket, and then the forward wall.

2. The system according to claim 1, wherein said separator carrier is a track.

3. The system according to claim 2, wherein said track is an endless track.

4. The system according to claim 1, wherein said at least one separator is a plurality of separators.

5. The system according to claim 1, wherein said at least one separator is adapted to sequentially release the rearward wall, at least a portion of the sheet in the pocket, at least another portion of the sheet in the pocket, and then the forward wall.

6. The system according to claim 2, wherein said track has elevational change sections for displacing said separator with respect to the pocket.

7. The system according to claim 6, wherein said sections include at least one of:

inclines for displacing said separator away from the pocket; and declines for displacing said separator towards the pocket.

8. The system according to claim 1, wherein said at least one lap separator is of a flexible material.

9. The system according to claim 1, wherein said at least one lap separator is a brush.

10. The system according to claim 1, wherein said at least one lap separator is a finger-shaped extension extending towards said pocket.

11. The system according to claim 10, wherein said extension is a row of finger-shaped extensions each extending towards said pocket.

12. The system according to claim 10, wherein said extension is one of a cylindrical rod and a rectangular column.

13. A sheet-opening system, comprising:

at least one moveable pocket having forward and rearward walls pivotally connected to one another, said forward and rearward walls together defining an opening for receiving at least one sheet, said at least one pocket adapted to travel in a transport direction at a given speed; and a lap separator system for opening the at least one sheet in said pocket, said separator system having:

a moveable separator carrier;

at least one separator connected to said separator carrier;

said separator carrier adapted to convey said at least one separator in said transport direction along said at least one pocket at a speed greater than said given speed; and said at least one separator adapted to sequentially contact said rearward wall, the at least one sheet in said pocket, and then said forward wall and to sequentially release said rearward wall, at least a portion of the at least one sheet in said pocket, and then said forward wall.

14. The system according to claim 13, wherein said separator carrier is one of a track and an endless track.

15. The system according to claim 13, wherein said at least one separator is a plurality of separators.

16. The system according to claim 13, wherein said at least one separator is adapted to sequentially release said rearward wall, at least a portion of the at least one sheet in said pocket, at least another portion of the at least one sheet in said pocket, and then said forward wall.

17. The system according to claim 14, wherein said track has elevational change sections for displacing said separator with respect to said pocket.

18. The system according to claim 17, wherein said sections include at least one of:

inclines for displacing said separator away from said pocket; and declines for displacing said separator towards said pocket.

19. A sheet-collating machine, comprising:

a conveyor adapted to travel in a transport direction at a given speed;

at least one sheet feeding device disposed at said conveyor for feeding at least one sheet towards said conveyor;

pockets each having forward and rearward walls pivotally connected to one another, said forward and rearward walls together defining an opening for receiving the at least one sheet, each of said pockets:

connected to said conveyor;

adapted to receive the at least one sheet from said at least one sheet feeding device; and adapted to transport the at least one sheet along at least a portion of said conveyor in said transport direction; and a lap separator system for opening the at least one sheet in at least one of said pockets, said separator system having:

a moveable separator carrier;

at least one separator connected to said separator carrier;

said separator carrier adapted to convey said at least one separator in said transport direction along said at least one pocket at a speed greater than said given speed; and said at least one separator adapted to sequentially contact said rearward wall, the at least one sheet in said pocket, and then said forward wall and to sequentially release said rearward wall, at least a portion of the at least one sheet in said pocket, and then said forward wall.

20. The machine according to claim 19, wherein said separator carrier is adjustable in a vertical direction with respect to said pockets.

21. The machine according to claim 19, wherein said at least one separator is adjustable in a vertical direction with respect to said pockets.

22. The machine according to claim 19, wherein:

said conveyor is an endless track; and said separator carrier is an endless track.

23. A method for opening a sheet within at least one sheet-receiving pocket of a sheet-collating device, which comprises:

conveying the at least one sheet-receiving pocket along a transport path in a transport direction at a given speed, the pocket having forward and rearward walls pivotally connected to one another, the forward and rearward walls together defining an opening for receiving the sheet;

placing the sheet in the at least one sheet-receiving pocket;

conveying at least one separator on a separator carrier along a second transport path in the transport direction at a speed greater than the given speed; and sequentially contacting the rearward wall, the sheet in the pocket, and then the forward wall with the at least one separator and then sequentially releasing the at least one separator from the rearward wall, at least a portion of the sheet in the pocket, and then the forward wall.

24. The method according to claim 23, wherein:

the at least one pocket is a plurality of pockets; and the at least one separator is a plurality of separators.

25. The method according to claim 24, wherein the second transport path is adjacent the transport path.

26. The method according to claim 23, wherein the second transport path follows the transport path.

27. The method according to claim 23, which further comprises sequentially contacting the rearward wall, the sheet in the pocket, and then the forward wall with the at least one separator and then sequentially releasing the at least one separator from the rearward wall, at least a portion of the sheet in the pocket, at least another portion of the sheet in the pocket, and then the forward wall.

28. A method for opening a sheet within a sheet-receiving pocket, which comprises:

providing sheet-receiving pockets to be conveyed in a transport path, each pocket having forward and rearward walls pivotally connected to one another, the forward and rearward walls together defining an opening for receiving the sheet; and displacing at least one separator to sequentially contact the rearward wall, the sheet in the pocket, and then the forward wall and then to sequentially release the at least one separator from the rearward wall, at least a portion of the sheet in the pocket, and then the forward wall.

* * * * *